US006568561B2

(12) United States Patent
Studer et al.

(10) Patent No.: US 6,568,561 B2
(45) Date of Patent: May 27, 2003

(54) DRIVE MECHANISM FOR A SOAP OR FOAM DISPENSER

(76) Inventors: Hans-Jörg Studer, Hurdstrasse 5, CH-8335 Hittnau (CH); Markus Ehrensperger, Weststrasse 3, CH-8442 Hettlingen (CH)

( * ) Notice: Subject to any disclaimer, the term of this patent is extended or adjusted under 35 U.S.C. 154(b) by 0 days.

(21) Appl. No.: 10/198,538

(22) Filed: Jul. 18, 2002

(65) Prior Publication Data

US 2003/0006246 A1 Jan. 9, 2003

Related U.S. Application Data

(63) Continuation of application No. PCT/CH00/00028, filed on Jan. 19, 2000.

(51) Int. Cl.[7] ..... B67D 5/60
(52) U.S. Cl. ..... 222/63; 222/214
(58) Field of Search ..... 222/63, 214, 190, 222/325, 333, 404

(56) References Cited

U.S. PATENT DOCUMENTS 4,722,372 A 2/1988 Hoffman et al.
5,186,360 A 2/1993 Mease et al.
5,492,247 A * 2/1996 Shu et al. ..... 222/63
5,829,636 A 11/1998 Vuong et al.
6,347,724 B1 * 2/2002 Chen et al. ..... 222/214

* cited by examiner

*Primary Examiner*—Philippe Derakshani
(74) *Attorney, Agent, or Firm*—Schweitzer Cornman Gross & Bondell LLP

(57) ABSTRACT

A device for the linear drive of a pumping member in a soap-type dispenser includes a crank mechanism with a crank disc and a push rod transmitting a linear movement to a piston rod. Disengageable coupling members are located between the push rod and the piston rod to disengage the piston rod when an actuating signal is not present. The coupling members can be re-engaged upon further movement of the crank disc. The device may be employed in conjunction with a motor driven pumping member and a sensor with a control circuit to detect the presence of a hand to be supplied with the soap and generate the actuating signal.

10 Claims, 6 Drawing Sheets

DRIVE MECHANISM FOR A SOAP OR FOAM DISPENSER

The present invention relates to a device for the linear drive of a pumping member in a media dispenser and is a Continuation of PCT/CH 00/00028 filed Jan. 19, 2000.

BACKGROUND OF THE INVENTION

Electrically operated soap and/or foam dispensers for hand washing are generally activated in a contactless manner by a sensor, i.e. a hand held out at a suitable distance sets a pump mechanism in action, so a portion of soap or foam is dispensed. If the hand is withdrawn prematurely or if someone wishes to "test" the action of the dispenser by passing the hand underneath quickly, the dispensed portion falls on parts of the wash basin and/or soils the floor.

This drawback has been recognised and an attempt made to eliminate it by reversing the direction of rotation of the drive motor as set forth in DE-A1-198 05 304. Here the presence of the hand to be provided with soap is monitored during the is pumping process. The necessary change in the drive and the subsequent mechanism from a forward direction to a reverse direction represents a complete reversal in the flow of energy and causes motor currents which are a multiple of the nominal current. Repeated successive actuation of the change in the direction of rotation can overheat and damage a small motor. In addition, the control circuit has to be equipped with components (transistors/thyristors, passive elements) which can process the maximum resulting high currents and are correspondingly expensive.

The object of the present invention is therefore to create a device which manages dispensation without the reversal of a drive motor, is economical and yet satisfies the requirements in service. The subject of the invention should stop the drive when the hand to be provided with soap is not removed at the correct time such that there is no soiling of the dispenser and its surroundings. In addition, the dispenser should be ready for use again after a short time and must not incur any damage even after repeated incorrect triggering of the metering process.

This object is achieved by the use of switchable coupling members between the drive motor and a piston rod of the pump member. A sensor controls the operation of the coupling members, which disengage the pump from the motor when a hand is not in the proper position for receipt of the pumped media.

Owing to the uncoupling of the piston rod the flow of power to the pumping member is interrupted so the flow of medium is stopped immediately. The relief applied to the pumping member and corresponding elastic components is sufficient in most devices to cause minimum backlash, preventing dripping of the medium.

The switchable members may be located between a push rod and the piston rod. The push rod converts the rotational movement of the motor into an oscillating movement in a compact manner. Transmission of the movement of the push rod to a coupling link facilitates the interruption and the subsequent restoration of the flow of power.

Inclusion of a locking cam and a spring-loaded locking lever on the push rod is particularly advantageous for quick unlocking and locking, i.e. for connection to the coupling link with an interlocking fit. Electromagnetic disengagement of the locking lever can also be provided.

A connecting link can be utilized to actuate the locking lever. Rotational loading of the connecting link through a joint head construction allows virtually any arrangement of the electromagnet and requires only small forces for uncoupling. Such a construction also allows the use of commercially available actuating magnets.

The joint head also allows an oscillating movement of the push rod to be converted into a linear pumping movement.

A leaf spring can be used to act on the connecting link and ensures reliable disengagement thereof.

An additional restoring force f applied to the piston increases the inherent backlash in the pumping member and prevents subsequent dripping, in particular if soap flakes undergo an expansion at an inner face next to the delivery aperture. The force should be as small as possible to conserve energy.

BRIEF DESCRIPTION OF THE DRAWINGS

Embodiments of the invention will be described hereinafter with reference to drawings, in which.

DETAILED DESCRIPTION OF THE INVENTION

Figure 1:
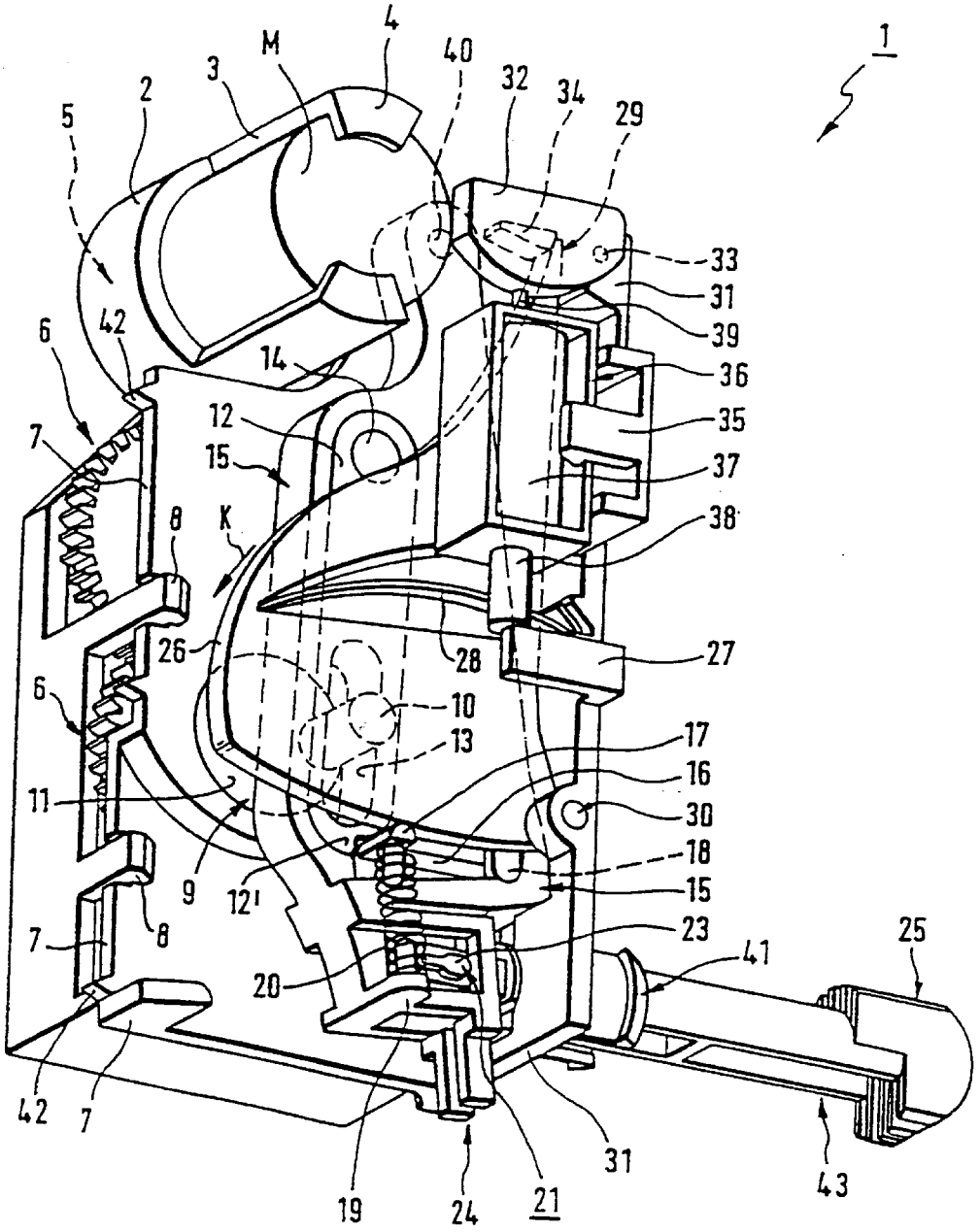
FIG. 1 is a perspective view of a drive mechanism for a hose pump in a soap dispenser in accordance with the invention.

A drive mechanism designated 1 as used in soap and foam dispensers can be seen in FIG. 1.

A commercially available electric motor M, a battery-operated d.c. motor, is inserted in a flange 2. The housing of the motor M is held by a resiliently configured carrier 3 with holding flanges 4. A drive pinion 5 (not shown) is located in the flange 2 and acts on a spur gear 6 placed on a gearing flange 7. An assembly angle 31 is arranged integrally and at a right angle on the gearing flange 7. The spur gear 6 is covered by a cover (not shown) held via clips 8 on the gearing flange 7.

A crank mechanism 9 with crank pin 10 projecting from a crank disc 11 and engaging in a guide groove 13 of a push rod 12 is located on the side facing the observer. The push rod 12 is mounted at one end on a swivel pin 14 and has a locking cam 12' at its opposing end. A coupling link 15 pivotal about a bearing journal 40 is connected with an interlocking fit at one end to the push rod 12, a latching pawl 16 locking the two components 12 and 15 in the position shown so the pawl rests with a locking lever 17 on the locking cam 12' of the push rod 12. The latching pawl 16 is in turn mounted at its lower end on a swivel pin 18. A cam-like spring mount 19, on which a flat coil spring 20 is supported and presses the locking lever 17 against the push rod 12 and the locking cam 12' in this case, is located at the lower end of the coupling link 15. A joint head 21 in which lateral cams 23 of a piston rod 43 are engaged is located next to and beneath the flat coil spring 20. The piston rod 43 carries a pump piston 25 and is centered on a trailing piston guide 41, the piston 25 actuating in a manner known per se as a hose pump for a soap solution. In addition, lateral cheeks 24 providing parallel guidance with a suitable flat part (not shown) engaging therein, are located beneath the joint head 21.

An elevation in which a pivotal cam disc 32 is mounted in a shaft 33 can be seen on the upper part of the assembly angle 31. A fixing piece 34 holding an upper support 29 of a connecting link 26 in the position shown is located behind the cam disc 32. This connecting link 26 is guided laterally by means of a lateral guide 27 next to which a leaf spring 28 is inserted and engages with its upper end in a recess of the connecting link 26 and biases the latter in the tilting direction K. A journal bearing 30 let into a further elevation of the assembly angle 31 serves as a pivot point for the possible tilting process in the direction K.

A magnet carrier 35 projects from the assembly angle 31, on which carrier an electromagnet 36 is positioned parallel to the assembly angle 31, in the solenoid 37 of which a vertically displaceably mounted armature 38 acts via a stud 39 on the components 32 and 34. In addition, wedge-shaped supports 42 project from the gearing flange 7. These serve as assembly aids in the dispenser.

In the figures hereinafter, identical functional parts are provided with identical reference numerals.

Figure 2:
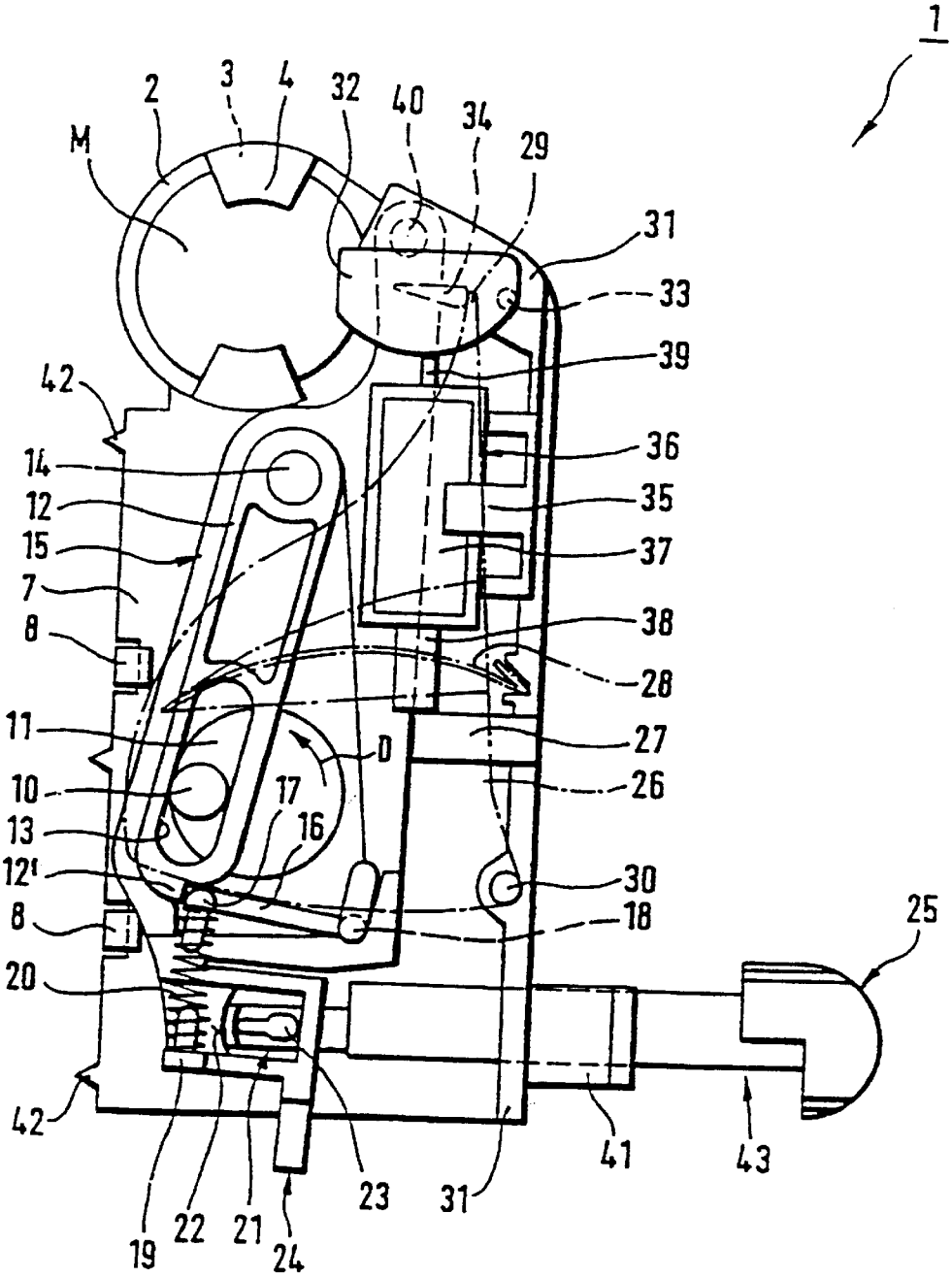
FIG. 2 shows the device from FIG. 1 in readiness for operation, in a lateral plan view.

FIG. 2 corresponds to FIG. 1, wherein the connecting link 26 present in FIG. 1 has been omitted for illustrative reasons or is shown only by a dot-dash line in this plan view. The power transmission from crank pin 10, rotating in the direction of the arrow D, via the coupling link 15 and a concave pressure face 22 present in the joint head 21 to the trailing end of the piston rod 43 can clearly be seen in this figure.

Figure 3:
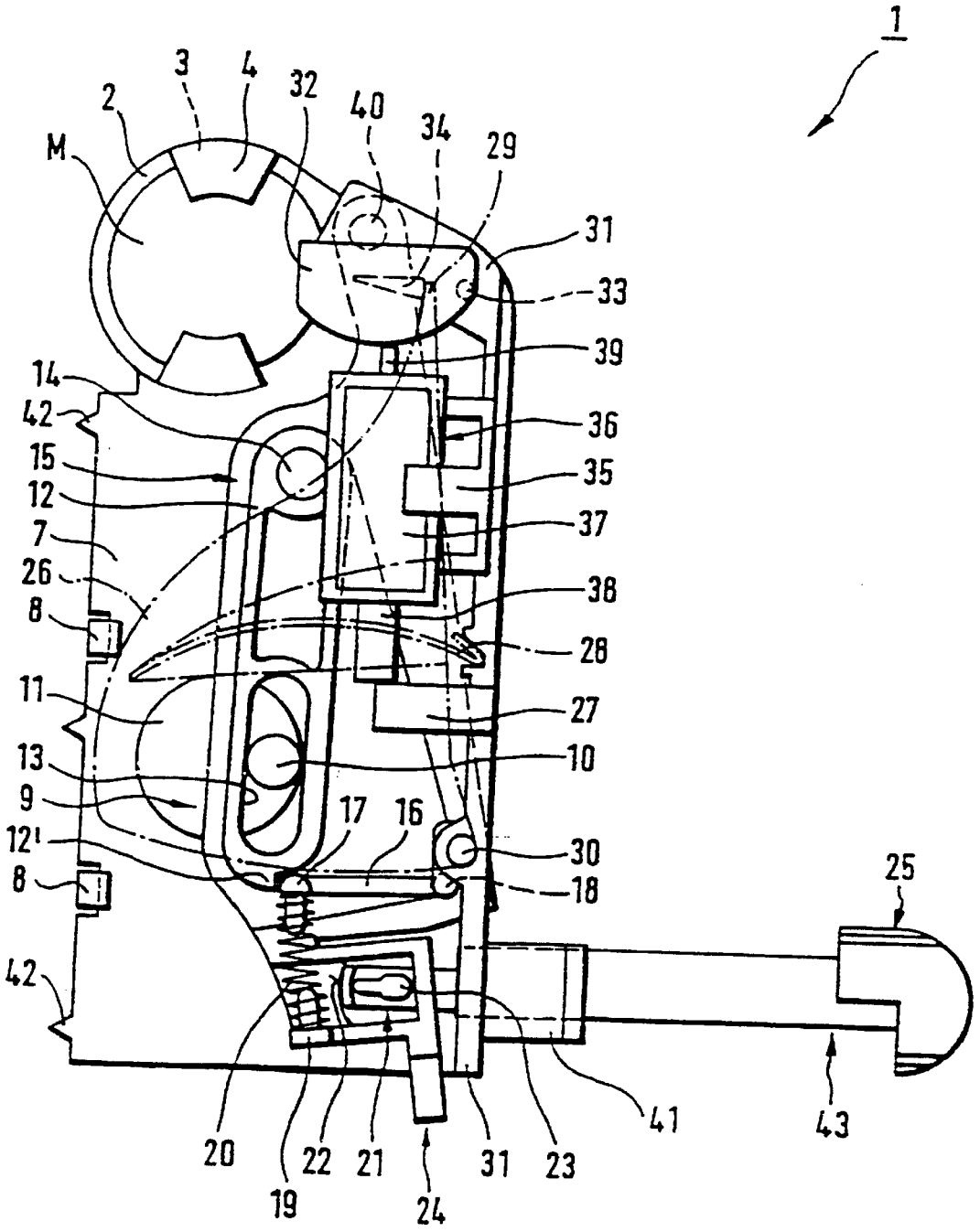
FIG. 3 shows the device of FIG. 2 in the pumping position (end position)

The diagram of FIG. 3 similar to FIG. 2 shows the pump piston 25 in its extended end position in which the crank pin 10 also assumes an extreme position.

Figure 4:
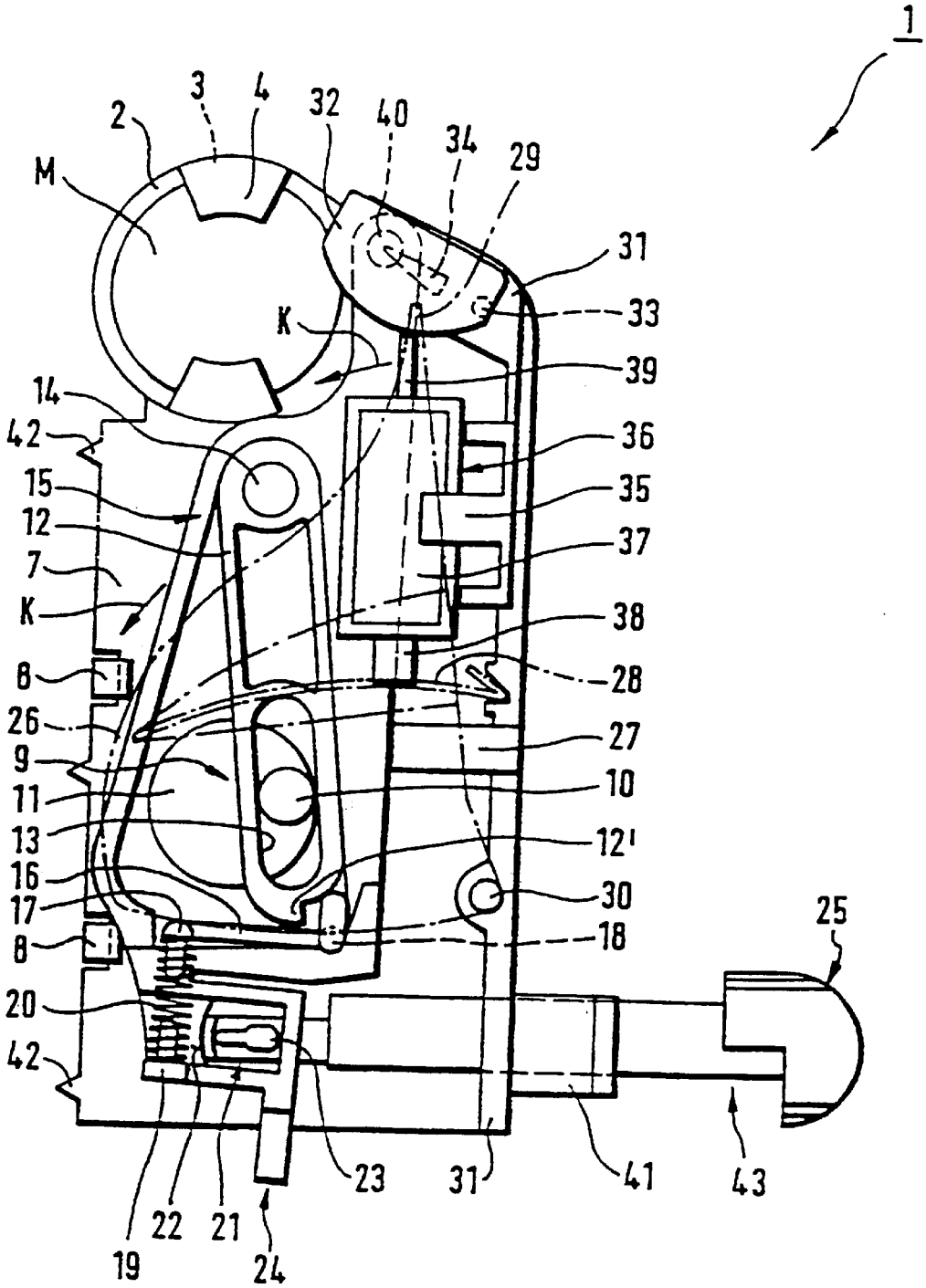
FIG. 4 shows the device according to FIGS. 1 to 3 with temporary interruption of the metering process.

If a signal is now emitted by a optical sensor present in the dispenser, after which the hand to be provided with soap is withdrawn, the supply of current to the motor M is interrupted immediately and the solenoid 37 immediately experiences a current pulse so the stud 39 travels upward causing the components 32 and 34 to pivot into the position shown in FIG. 4 so the connecting link 26, shown in dot-dash lines, has pivoted about the journal bearing 30 in the tilting direction K.

It is obvious that in this position shown in FIG. 4 there is no flow of power from the motor M via the drive mechanism to the piston rod 43. The piston rod 43 is "freely switched" and owing to the inherent elasticity of the hose pump (not shown here) undergoes a shift back into the starting position.

The crank mechanism 9 used now proves to be advantageous: as soon as the motor M is again supplied with current the push rod 12 returns to its starting position connected to the coupling link 15. The locking lever 17 engages again and is connected to the locking cam 12'. Consequently, a flow of power from motor M to piston 25 is again possible. The drive mechanism 1 is ready for operation again without further mechanical and/or electrical measures being necessary.

Figure 5:
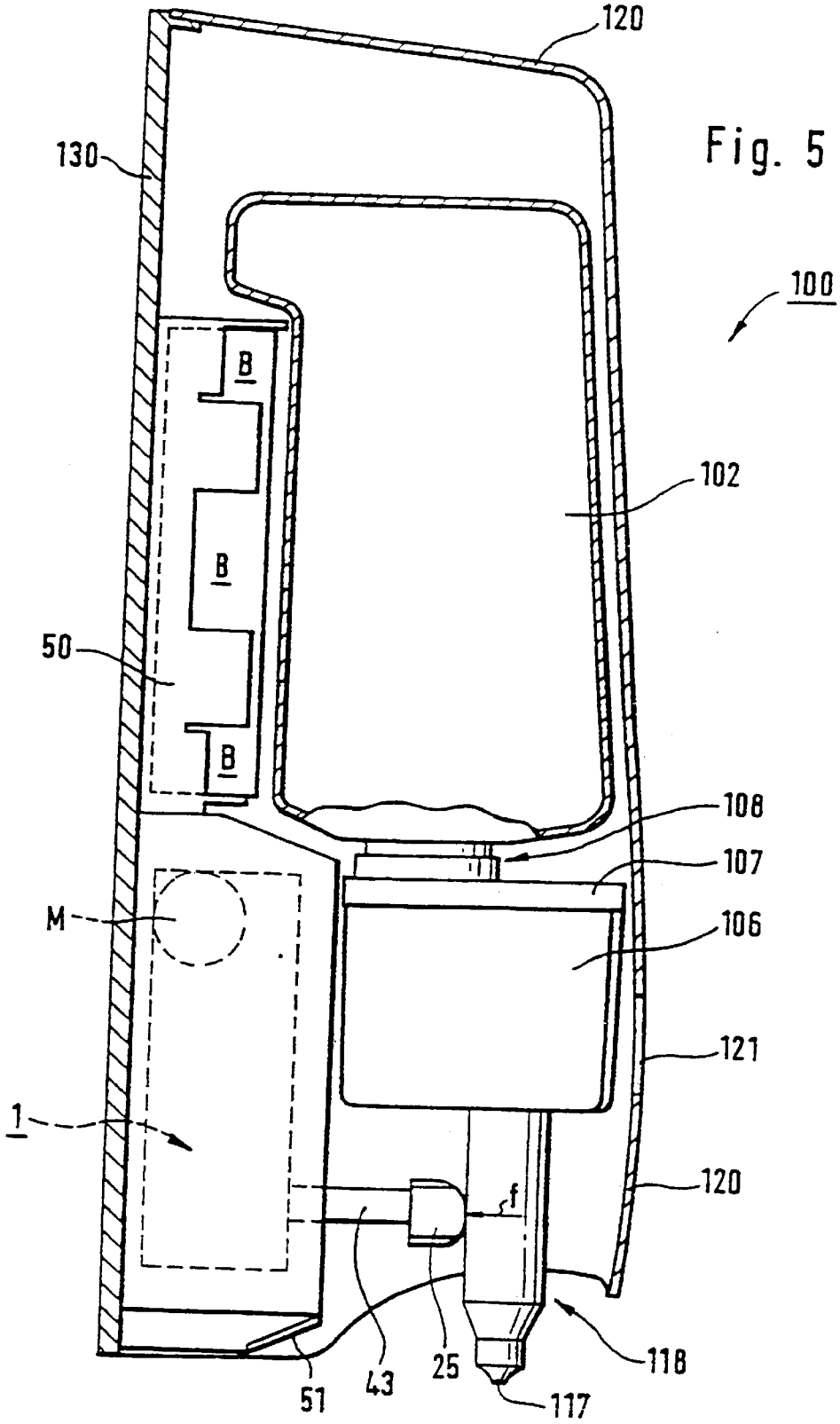
FIG. 5 shows the drive mechanism with its battery current supply, installed in a soap dispenser to be operated in a contactless manner.

According to FIG. 5 a drive mechanism 1 according to the invention is placed on a back wall 130 in a soap dispenser 100 and provided with current by commercially available batteries B mounted in a well known battery compartment 50. A sensor 51 (light barrier), also commercially available, detecting the presence of a hand is located on the bottom of the dispenser 100.

FIG. 5 also shows a housing 120 with a window 121 at the front, behind which a level indicator known per se of the intermediate container 106 is arranged.

The soap dispenser 100 has a supply bottle 102 placed upside down in an adaptor 108 on a cap 107 of an intermediate container 106 serving as reservoir. The piston rod 43 issuing from the drive mechanism 1 acts with its pump piston 25 on a hose pump 118 and actuates (opens) the rubber lip of a soap outlet 117 during portioning of soap.

The inherent elasticity of the hose pump 118 is sufficient for the soap outlet 117 to close and the piston 25 to return as soon as the drive mechanism 1 arrives in the state described in FIG. 4. The hose pump 118 therefore acts as a restoring spring. The restoring force resulting from the hose pump 118 is designated by f and acts directly on the pump piston 25.

Figure 6:
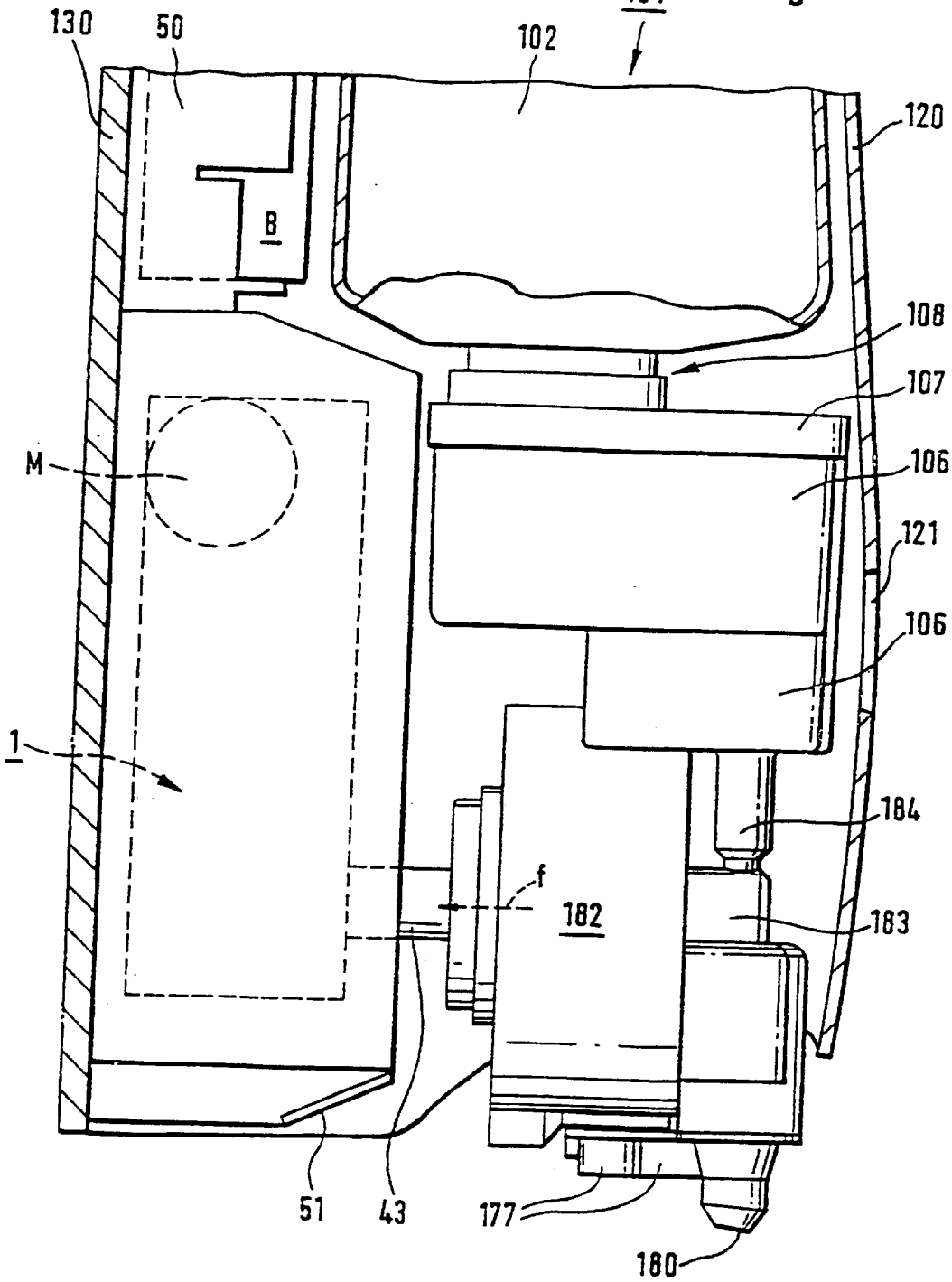
FIG. 6 is an enlarged diagram similar to FIG. 5 using an example of a foam dispenser.

The same function is performed in a foam dispenser 101 according to FIG. 6, though this does not contain a restoring hose pump but a restoring spring in the pneumatic cylinder 182. The soap solution is supplied in the same manner as in the soap dispenser in FIG. 5 albeit here via a passage pin 184 fed by a soap metering cylinder 183. The soap exits in the form of fine pored foam via a delivery aperture 180.

The disengagement of the piston rod 43 alone causes a return stroke owing to the gas bubbles present in the pneumatic/hydraulic system, so no soap foam and/or soap solution drips from the aperture 180 when the hand is withdrawn. In addition, there is a nozzle/expansion space 177 which allows foam possibly present in the delivery aperture 180 to expand so it disintegrates and foams again during the next pumping process.

The subject of the invention may be largely produced from conventional plastics materials and is accordingly inexpensive. The electric motor M used is commercially available (Mabuchi, Japan, FF-180PH-2852 type). The nominal speed is 6,500/min, the nominal power 1.3 W. The transmission ratio of the spur gear 6 is 200:1. The motor controller and the evaluation of the sensor signal are performed in a well known manner and are designed for minimal energy demand.

Calculations have shown that a dispenser can be operated with two monocells of 1.5 volt (BABY LR 14) for one year without battery change even in a frequently used washroom.

Of course the subject of the invention is not limited to the embodiment described, thus, for example, the commercially available electromagnet 36 used can be replaced by a smaller one acting directly on the locking lever 17. As a result at least the connecting link 26 and the components 32 to 34 may be dispensed with.

The embodiments described are designed for delivery of a medium into a hand but they may also be extended by suitable sensors to a variation intended for delivery of the medium into both hands.

In general, functional dispensers operating in a contactless manner contribute to an improvement in hygiene and prevent the transmission of germs to unappealing operating members as exhibited by manually operated soap and foam dispensers.

We claim:

1. A device for the linear drive of a pumping member in a dispenser for free-flowing media of the type having an electric motor, a sensor with a control circuit to detect the presence of a hand to be supplied with the media to trigger a pumping process and interrupt the pumping process when the hand is no longer present in a region receiving the media in such a way that the media remains in the dispenser without dripping, comprising a crank mechanism connected to the electric motor, the crank mechanism including a crank disc and a push rod transmitting a linear movement to a piston rod; disengagable coupling members being located between the push rod and the piston rod to disengage the piston rod when the hand is no longer present, and spring-loaded means to re-engage the coupling members upon a further movement of the crank disc of the crank mechanism.

2. The device according to claim 1, wherein the push rod has a guide groove in which a crank pin engages.

3. The device according to claim 1 or 2, wherein the push rod is held with an interlocking fit on a coupling link at a longitudinal side remote from the piston rod, the coupling link being pivotal about a bearing journal.

4. The device according to claim 1 or 2, wherein the push rod has a locking cam at an output side thereof, a spring-loaded locking lever resting on the locking cam.

5. The device according to claim 4, further comprising an electromagnet for disengaging the locking lever.

6. The device according to claim 5, further comprising a connecting link for indirect switching of the locking lever.

7. The device according to claim 3, wherein the coupling link has a joint head at an output side in which a pressure face for a trailing end of the piston rod is provided.

8. The device according to claim 6, further comprising a leaf spring supported on an assembly angle to act on the connecting link, the leaf spring loading the connecting link in a tilting direction.

9. The device according to claim 1, further comprising means for directing a restoring force onto the piston rod or pump piston to load the pump piston against the direction of movement of the pumping process.

10. The device according to claim 9, characterized in that the restoring force is such that the uncoupled piston rod is pushed back into a region of its position upon triggering of the pumping process.

* * * * *

UNITED STATES PATENT AND TRADEMARK OFFICE

CERTIFICATE OF CORRECTION

PATENT NO. : 6,568,561 B2 
DATED : May 27, 2003
INVENTOR(S) : Hans-Jorg Studer et al.

It is certified that error appears in the above-identified patent and that said Letters Patent is hereby corrected as shown below:

Title page,
Insert Item -- [73] Assignee: HTS International Trading AG, Baar, Switzerland --

Signed and Sealed this

Fifth Day of August, 2003

JAMES E. ROGAN
*Director of the United States Patent and Trademark Office*